US005913933A

United States Patent [19]

Beetz et al.

[11] Patent Number: 5,913,933

[45] Date of Patent: Jun. 22, 1999

[54] PLIERS FOR CRIMPING WORKPIECES

[75] Inventors: Horst Beetz, Stadtallendorf; Kurt Battenfeld, Ebsdorfergrund-Wittelsberg, both of Germany

[73] Assignee: Wezag GmbH Werkzeugfabrik, Stadtallendorf, Germany

[21] Appl. No.: 09/053,268

[22] Filed: Apr. 1, 1998

[30] Foreign Application Priority Data

Apr. 2, 1997 [DE] Germany ..... 197 13 580

[51] Int. Cl.[6] ..... B21D 41/04; H01R 43/042

[52] U.S. Cl. ..... 72/409.16; 72/409.12; 72/413; 29/751; 81/421

[58] Field of Search ..... 72/409.16, 409.12, 72/409.01, 413, 481.8; 81/421–423, 363, 362; 29/751

[56] References Cited

U.S. PATENT DOCUMENTS

| | | | |
|---|---|---|---|
| 2,928,299 | 3/1960 | Fuller | 81/362 |
| 2,952,174 | 9/1960 | Broske | 72/409.01 |
| 3,029,670 | 4/1962 | Over | 81/15 |
| 3,345,856 | 10/1967 | Werner | 72/409.01 |
| 3,571,888 | 3/1971 | Di Fillippo | 72/421 |
| 3,903,725 | 9/1975 | Rommel | 81/422 |
| 4,719,789 | 1/1988 | Wiebe | 72/416 |
| 5,113,727 | 5/1992 | Foster | 81/423 |

FOREIGN PATENT DOCUMENTS

| | | | |
|---|---|---|---|
| 21 49 167 | 1/1971 | Germany . | |
| 2841588 | 3/1980 | Germany | 72/409.01 |
| 32 05 110.7 | 2/1982 | Germany . | |
| DIN 41 641 | 10/1984 | Germany . | |

OTHER PUBLICATIONS

Prospectus Grote & Hartmann, pp. 626–629.

*Primary Examiner*—Daniel C. Crane

*Attorney, Agent, or Firm*—Thomas, Kayden, Horstemeyer & Risley

[57] ABSTRACT

A pliers for crimping workpieces is disclosed. The pliers for crimping workpieces comprises a pliers head (1) with two cover plates (2,3), the pliers head having one stationary crimping die (20) and a linearly movable crimping die (20), of which at least one of the crimping dies is interchangeable, and a toggle lever drive (33) for moving the linearly guided movable crimping die (26), the toggle lever drive (33) having one movable handle (14) and one stationary handle (4) and being provided with one toggle lever link (10) pivotedly arranged on the handles. A double support (24) consists of a first support with a retractable bolt (18,28) being retractable from the pliers head and a circumferentially closed opening (22) in the crimping die and a second support (25) with a stationary bolt (19,29) in the pliers head and a circumferentially opened opening (23) in the crimping die is provided for realizing interchangeability of at least one of the crimping dies (20,26) and for transfering the crimping forces to the pliers.

11 Claims, 7 Drawing Sheets

PLIERS FOR CRIMPING WORKPIECES

FIELD OF THE INVENTION

This invention relates in general to a pliers for crimping workpieces. More particularly, this invention relates to a pliers for crimping workpieces comprising a pliers head with two cover plates, the pliers head having one stationary crimping die and a linearly movable crimping die, of which at least one of the crimping dies is interchangeable, and a toggle lever drive for moving the linearly guided movable crimping die, the toggle lever drive having one movable handle and one stationary handle and being provided with one toggle lever link pivotally arranged on the handles. The pliers may be provided with an automatic locking mechanism consisting of a tooth segment and a pivotally arranged lock pawl for repetition accuracy of travel to an end position and a return spring for reaching the open position of the crimping dies and the handles. The pliers can be utilized for the production of solderless joints between current-carrying cables and the corresponding connection elements by compression of a workpiece designed accordingly. In other respects, the pliers can also be utilized when workpieces are to be permanently crimped. The construction of the crimping dies is carried out such that they are arranged to meet the shape intended on the workpiece. The crimping dies consist of one or several die plates which are matched to each other and, depending on the case of application, can have an extremely complex shaping design.

BACKGROUND OF THE INVENTION

A pliers of the design described above is known in DE 21 49 167 C3. This pliers is constructed using a laminar plate design. It has a pliers head and two cover plates, two insertion plates, one on the specified handle plate attached to the stationary handle and several bolts and pins with which the parts of the pliers head are held together. A toggle lever action drive is located in the pliers head consisting of a movable handle and a toggle lever link which drives the guide tab supporting two pins. The first pin is designed to pivot the free end of the movable handle whereas the second pin serves for interchangeable support for an interchangeable crimping die. Both the movable as well as the stationary crimping die are interchangeable in the pliers head, the stationary crimping die being supported by projections on the cover plates and held otherwise in place by detachable bolts between the cover plates. The movable crimping die is seated on the guide tab and is held in place by a lip provided at this location. The crimping dies are, however, always interchangeable and, as a consequence, designed for replacement by other die shapes. The disadvantage of this crimping pliers is the large number of required parts as well as the arrangement of the return spring in the pliers head in the area of the crimping dies.

From DIN 41 641 from October 1984, it is known that such interchangeable crimping dies on such manual crimping tools are supported using a safety stop with a spring-loaded ball. This safety stop serves only for insertion of the crimping die in the pliers head. For transmission of the compression forces, this safety stop serves no purpose.

On the other hand, crimping dies using a screwed connection on the pliers head are known. Also in this case, the absorption of force in the pliers head is not optimal. The crimping dies can only move slightly in the pliers head under the influence of the compression force causing a tilting or twisting so that the exact relative position of the crimping dies in the end position of the compression operation is no longer reproducible for extended periods.

SUMMARY OF THE INVENTION

It is an object of this invention to create a pliers of the type mentioned above which offers simplicity in design and has few parts, in which at least one of the crimping dies, preferably, however, both crimping dies can be easily interchangeable and still nevertheless supported reliably and securely in the pliers head so that reproducibility of the prescribed end position for the compression operation is maintained.

In accordance with the invention, this will be attained by a pliers of the type mentioned above in such a way that a double support consisting of a first support with a retractable bolt being retractable from the pliers head and a circumferentially closed opening in the crimping die and a second support with a stationary bolt in the pliers head and a circumferentially opened opening in the crimping die is provided for realizing interchangeability of at least one of the crimping dies and for transfering the crimping forces to the pliers.

The invention is based on the idea that for realizing interchangeability of at least one of the crimping dies and for transfering the crimping forces to the pliers a double support, meaning a two-point support, is to be prescribed. The two supports are arranged at a distance to each other so that under the influence of the supports the corresponding crimping die is not subject to twisting in the pliers head. One of the two supports for each die consists of a circumferentially closed opening in the crimping die and a retractable, i.e. screwed or extractable and replaceable bolt which extends through the two cover plates and passes through the circumferentially closed opening in the corresponding crimping die. This crimping die is designed for direct absorption of the crimping force and/or reaction force. The other support is formed by a stationary bolt in the pliers head in the cover plates in conjunction with a circumferentially opened opening (margin perforation) in the associated interchangeable crimping die. By stationary bolt we mean a bolt which, on the one hand, can be installed and/or removed but, on the other hand, does not have to be removed for exchanging crimping dies. The replaceability of the crimping dies relates to the exchange of one corresponding pair of crimping dies for another pair of crimping dies when, for example, wear takes place in the die plates after corresponding period of use. The replaceability also relates to the exchange and/or replacement of one pair of crimping dies with a specific die shape for another pair of crimping dies with a different die shape in order to be able to carry out various crimping operations with the same pliers. By means of this double support, the proximity, and, the relative angle, with which the crimping dies are specifically arranged in the pliers head, are distinctly determined and reproducible.

The new crimping pliers has an especially simple design and is composed of relatively few parts. In comparison with the generic pliers, shim plates as well as a guide piece for the movable crimping die are no longer required. In addition, the stationary handle does not have to be designed to extend to the front end of the pliers head. By means of the double support of the crimping dies, a better tensional connection between the crimping dies and the cover plates is produced. The elastic motion of the cover plates with respect to each other is utilized beneficially. On tightening the stationary crimping die, this connection acts as reciprocal support for the cover plates, thereby supplying rigidity to the pliers head. The compressive force acting on the movable crimping die through the movable handle is directly transmitted creating direct effect from the toggle action produced by the toggle tab. Finally, the crimping dies themselves can also be produced in laminated design. On the other hand, it is also feasible to use high-quality cast crimping dies.

Especially in connection with this fact, the return spring in the pliers head is provided between the cover plates and supported by the stationary handle, and the toggle lever link. The return spring, therefore, no longer grips on the movable crimping die but on the toggle lever link. This fact, as a consequence, eliminates the need to replace or remove the return spring when changing the movable crimping dies simplifying fundamentally the replacement procedure for the movable crimping die. In addition, the actual direction of force of such a return spring which is arranged and supported is such a manner is optimal. After the execution of a crimping operation and arrival at the end position, the return spring returns the handle as well as the crimping dies to the initial open position. The return spring is protected in the pliers head and does not block, for example, the wedge area between the handles.

The invention can be applied with great benefit to the movable crimping die. As a consequence, the linearly guided movable crimping die with the circumferentially opened opening is arranged directly on a front end of the movable handle, in which the stationary bolt is supported, and the retractable bolt and the stationary bolt both are guided in elongated cut-out holes in the cover plates. The retractable bolt and the stationary bolt are supported in elongated cut-out holes in the cover plates. The guide tabs with pins and additional joints are eliminated as well as the necessary play so that not only the number of required components is reduced but also the end position can be maintained more precisely. The retractable bolt can also, in principle, be divided into a bolt shaft and an easy-to-handle knurled screw.

A connection link is provided, which is designed to be detachable by the retractable bolt of the guided crimping die and located between the guided crimping die and the movable handle. This connection link transmits the force of the return spring to the movable guided crimping die so that after a crimping operation the pliers are returned to the open position. The connection link is pivoted on the retractable bolt of the guided crimping die so that on loosening or tightening the bolt, the connection at the same time by the connection link is made or broken respectively.

In one aspect of the invention, the retractable bolt of the guided crimping die comprises a stop for positioning the workpiece with respect to the dies. In this way, the stop, which, for example, determines the relative position of the insulation of an electric conductor relative to the crimping die, can be utilized for arrangement to the corresponding crimping die. A special detachable attachment device for a positioning end stop is thereby eliminated. It is, of course, necessary to maintain the relationship between the positioning end stop and the movable crimping die.

The interchangable crimping die is of laminated design. In this way, a simple method of production for the crimping dies is attained. As such an end stop is in exact correlation to the corresponding crimping die and arranged, for example, in the center area of the crimping die, such an end stop represents an integral component of the crimping die and will also be replaced on replacement.

The stationary handle may also comprise a double support on the free end area in the pliers head, the double support being composed of two bolts, of which at least one of the bolts is designed to be retractable. At this position the double support in accordance with the invention can also be applied when one of the bolts is designed to be retractable. This possibility serves the purpose, for example, of being able to pivot the stationary handle relative to the pliers head in the case of breakage of the return spring in order to be able to easily remove the defective spring and replace it with a new return spring. Generally, it does not play a role whether or not a torsion tool is to be used for removal of the bolt. In contrast with this bolt, knurled screws are preferably utilized for the other retractable bolts so that replacement of the crimping dies can be carried out without tools making possible replacement by hand.

An automatic locking mechanism consisting of a tooth segment and a pivotally arranged lock pawl may be provided for repetition accuracy of travel to an end position and the tooth segment of the automatic locking mechanism may be located at the free end of the movable handle. The automatic locking mechanism is installed in the area of the pliers head under protection. By means of this design, the free end of the movable handle is integrated with the tooth segment of the automatic locking mechanism. The movable handle as such is then simultaneously designed as tooth segment of the automatic locking mechanism and can be produced in one stamping operation using simple production methods. The associated lock pawl may be located between the cover plates and supported to allow pivoting action and can be arbitrarily unlocked and the stationary handle, the free end of which extends into the pliers head on the one hand, and the edge of the crimping die on the other hand, form end stops for limiting the pivoting action of the lock pawl. The associated lock pawl is pivotable in the cavity formed by the two cover plates and suspended to allow movement under spring tension so that opening and closing action which has been started can only be completed when complete travel has been made. Above all, the lock pawl is supported so that pivot movement can be carried out between the cover plates and can be unlocked arbitrarily, whereas, the free end on the stationary handle leading into the pliers head and, the edge of the guided crimping die form end stops for the limitation of the arbitrary pivoting motion. This arbitrary pivoting and unlocking capability make it possible to interrupt a closing operation, for example in the case of a inserted defective workpiece so that damage to the crimping dies can be prevented. The lock pawl can be pivoted to a neutral position which releases the motion of the guided crimping die in both directions. When doing so, however, the arbitrary pivoting of the lock pawl is limited so that overwinding the spring, which places tension on the lock pawl, is eliminated.

The pliers head may be designed as a hollow housing by the cover plates connected to one another at a certain distance by stationary pins and bolts, the cover plates are C-shaped and the replaceable crimping dies are designed to be inserted in the cavity between the cover plates in two directions perpendicular to each other. This shape of construction is especially advantageous in conjunction with the design in accordance with the invention.

Thus, these and other objects, features and advantages of the invention will become apparent upon reading the specification when taken into conjunction with the accompanying drawings wherein like characters of reference designate corresponding parts throughout the several views.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
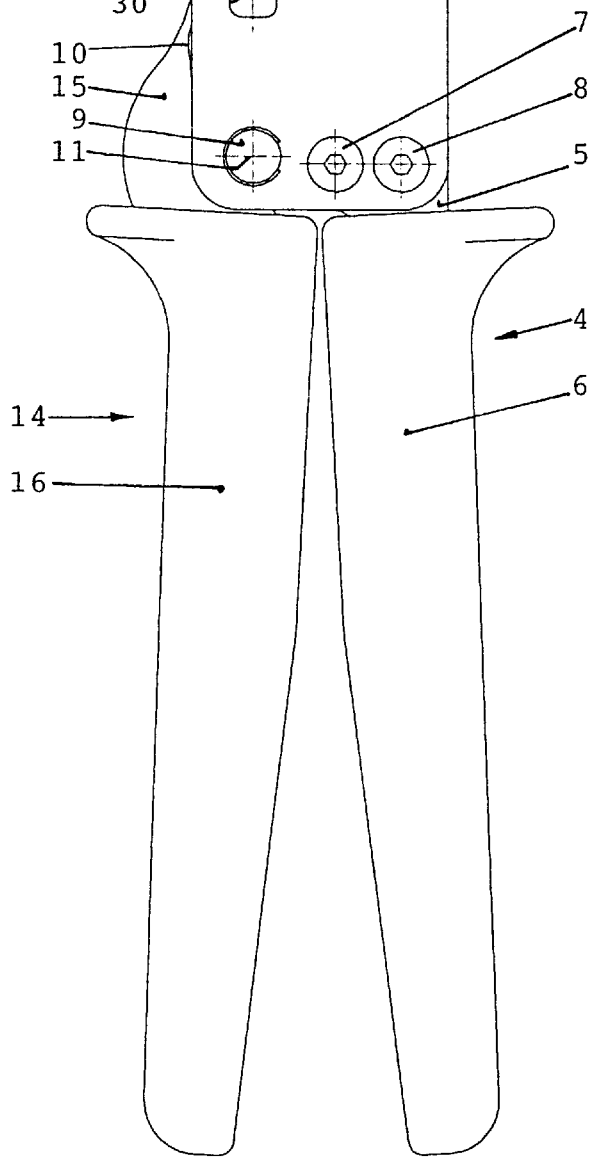
FIG. 1 illustrates a view of the pliers of the invention in closed position without crimping dies.
Figure 5:
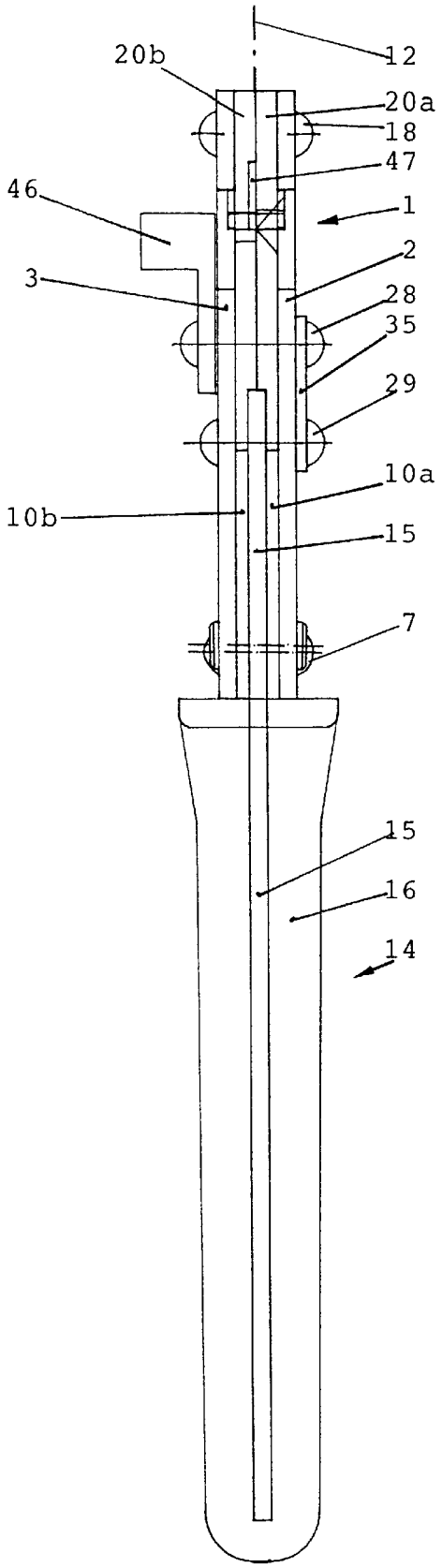
FIG. 5 illustrates a front view of the pliers.

Referring now in detail to the drawings, the pliers shown in FIG. 1 is provided with a pliers head 1 essentially consising of two identically shaped cover plates 2, 3, held together with several pins and bolts at a distance to each other (shown in FIG. 5). A stationary handle 4 is connected to the two cover plates 2, and 3. The station handle for consists of a stamped component 5 in laminar construction (FIG. 8) covered with a slide-on plastic element 6. The stamped component 5 is firmly connected to the cover plates 2 and 3 by two bolts 7, 8, passing through corresponding openings in the two cover plates 2, 3 and the stamped component 5. Each bolt 7, 8 can be composed, for example, of a bolt shaft with internal thread and a screw-shaped element with a shaft and corresponding outside threading.

By means of a pin 9, the toggle lever link 10 is pivotable about an axis 11 with respect to cover plates 2 and 3 and supported on the pliers head 1. The toggle lever link 10 consists of two identical toggle lever links 10*a* and 10*b*, which, in similarity with the two cover plates 2 and 3, are arranged symmetrically to a center plane 12 (FIG. 5). A movable handle 14 is attached by means of a pin 13 with pivot action, which, in similarity with the stationary handle 4, consists of a stamped component 15 and a plastic element 16. The stamped element 15 (FIG. 17) extends between the two toggle lever links 10*a* and 10*b* into the interior between the two cover plates 2 and 3 where the front end section 17 of the movable handle 14 is located.

The two cover plates 2 and 3 have a C-shaped design and are fixed in place by a retractable bolt 18 and a stationary bolt 19 at a distance to each other and located on the side as seen looking away from the user. In a preferred embodiment, the bolts 18, 19, consist of a basic bolt shaft with internal thread and a screw-shaped element with shaft and corresponding outside threading. Both elements can have hexagonal depressions for insertion of torsion tool. In another aspect of the present invention, the screw-shaped element designed as a knurled screw in order to permit manual activation without application of a tool. This applies especially to the retractable bolt 18.

Figure 2:
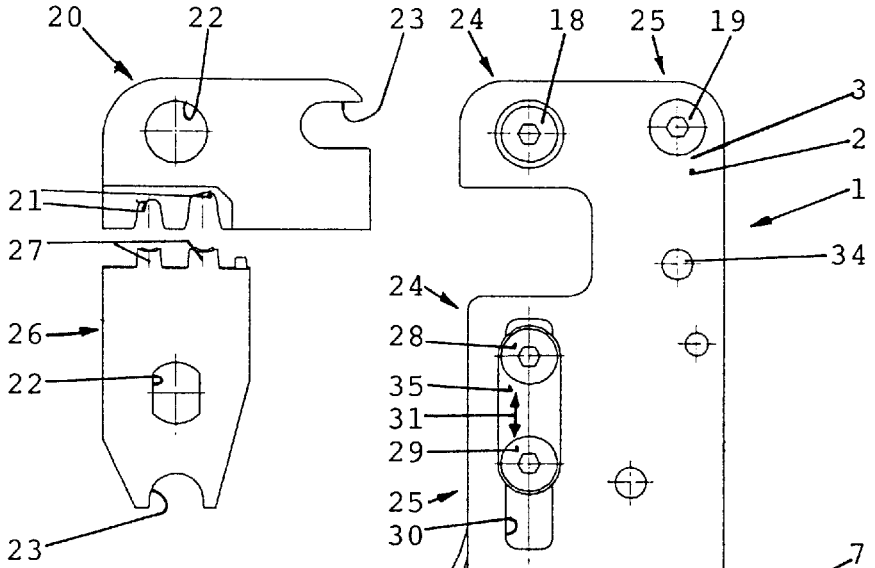
FIG. 2 illustrates a view of the crimping dies for the pliers of FIG. 1.

The bolts 18 and 19 serve to form the reproducible support for a stationary crimping die 20. The crimping die 20 is represented in FIG. 2. It has one or more die plates 21, a circumferentially closed opening 22 and a circumferentially opened opening 23. The crimping die 20 can be finished out of several plates 20*a*, 20*b* (FIG. 5) resulting in a laminar design. It is also possible to utilize a stationary crimping die 20 made of high-quality cased material. Although described herein as being formed of particular materials, it will be understood the elements can be made of other suitable materials. The crimping die 20 is inserted after removing the retractable bolt 18 in the direction normal to the two cover plates 2 and 3 such so that the circumferentially opened opening 23 grips the stationary bolt 19. The external contour of the crimping die 20 can be adapted to the external contour of the cover plates 2, 3 so that the specified end position is easily recognizable. After insertion, the retractable bolt 18 is replaced and tightened. The stationary crimping die 20 is tightly and non-displaceably seated in the pliers head 1 and supported in terms of forces acting on the crimping die 20 by the double support derived from the specified bolts 18 and 19 located at a distance to each other. The double support of the crimping die 20 is situated in a horizontal manner. The bolt 18, in conjunction with the circumferentially closed opening 22, forms the first support for the crimping die 20. The circumferentially opened opening 23, in conjunction with the stationary bolt 19, forms a second support 25 for the crimping die 20.

Figure 3:
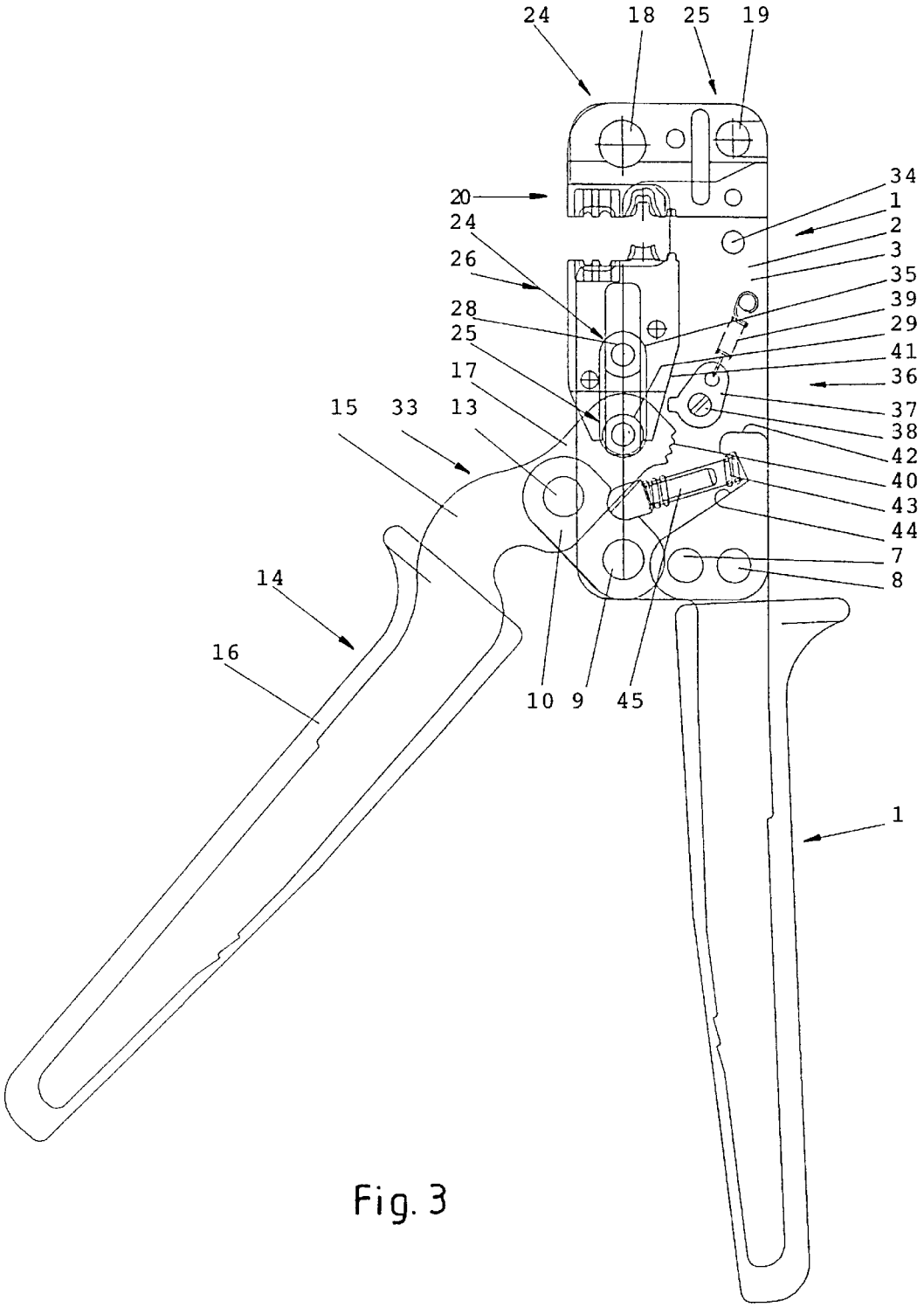
FIG. 3 illustrates a representation of the pliers in opened position.
Figure 4:
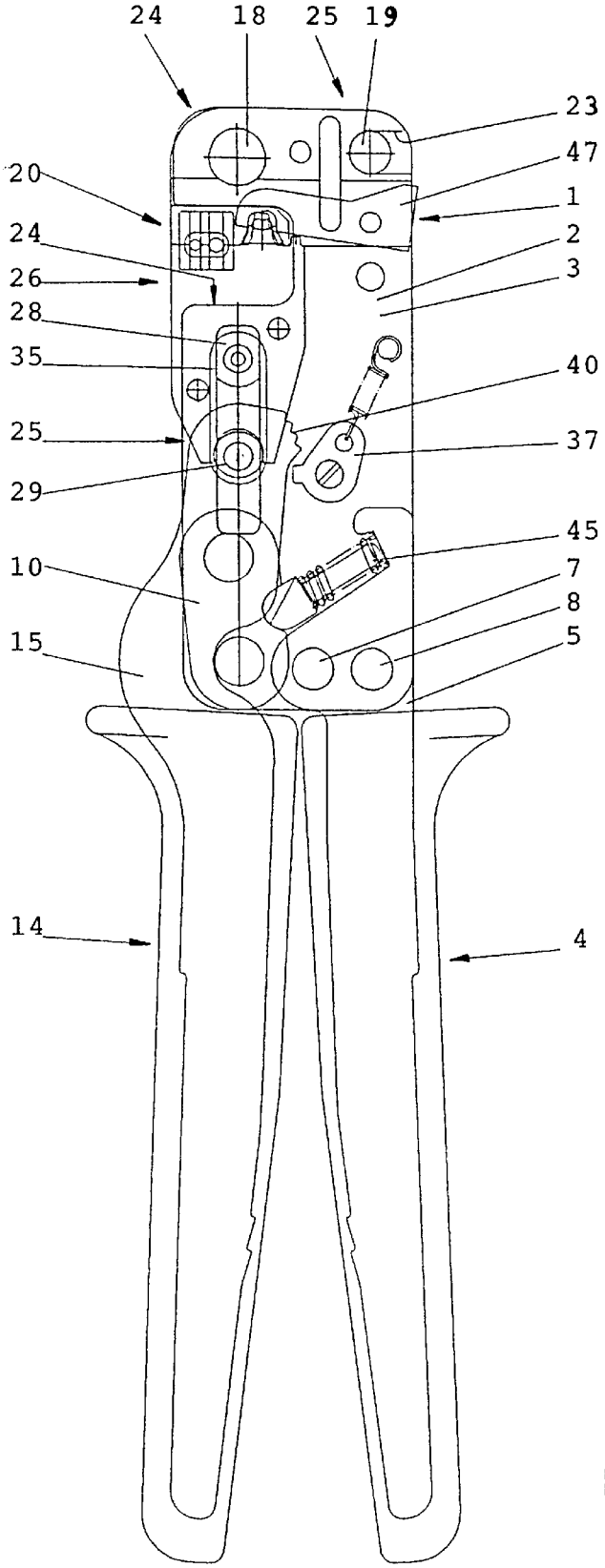
FIG. 4 illustrates a representation of the pliers after a closing operation in the end position.
Figure 7:
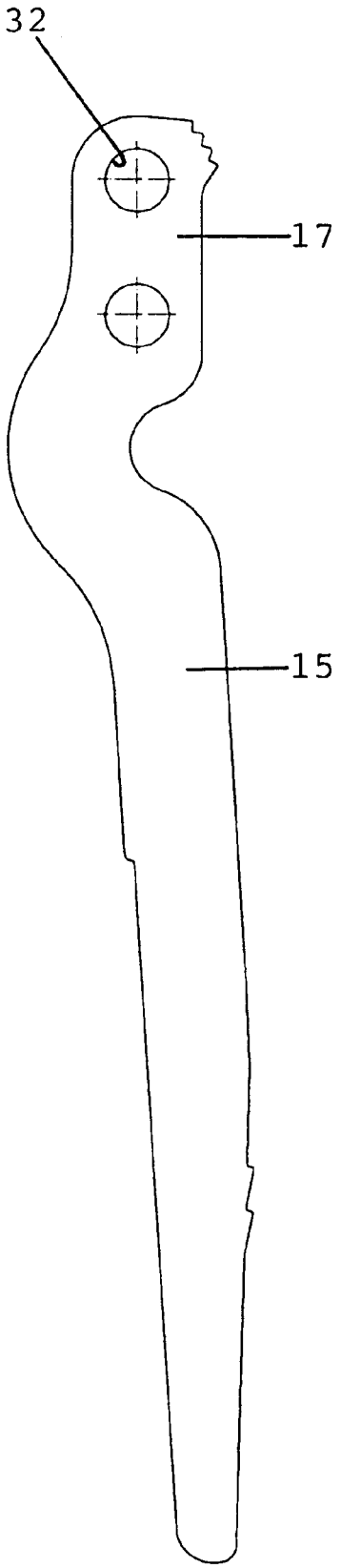
FIG. 7 illustrates a top view of the movable pliers handle and FIG. 8 illustrates a top view of the stationary pliers handle.

In the preferred, embodiment a movable crimping die 26, is aligned with the stationary crimping die 20 and has two integrated die plates 27. The movable crimping die 26 includes a double support consisting of a circumferentially closed opening 22 and a circumferentially opened opening 23. In similarity with the stationary crimping die 20, a retractable bolt 28 is included for the replaceable support of the movable guided crimping die 26 as well as a stationary bolt 29. On the movable crimping die 26, the retractable bolt 28 forms the first support 24 in conjunction with the circumferentially closed opening 22. A second support 25 is formed by the stationary bolt 29 in conjunction with the circumferentially opened opening 23 of the movable crimping die 26. The first support 24 and the second support 25 establishing a double support on the movable crimping die 26. The double support of the movable crimping die 26 is situated in a vertical manner. The bolts 28 and 29 pass through not only the openings 22 and 23 but also an additional elongated cut-out hole 30 in the cover plates 2 and 3 thereby the movable crimping die 26 is guided in a linear direction in the pliers head 1 as indicated by the double headed arrow 31. The stationary bolt 29 also passes through a perforation 32 (FIG. 7) in the frontal end area 17 of the stamped component 15, so that the movable handle 16 is simultaneously pivotable at the pliers head and displaceable in the longitudinal guided direction. The movable handle 14 together with the toggle lever link 10 forms the toggle lever drive 33 which is applied between its open position (FIG. 3) and its closed position (FIG. 4) until shortly before reaching the dead-center position. Thereby the movable crimping die 26 is driven by this toggle lever drive 33. The two cover plates 2 and 3 are supported reciprocally by a pin 34 and maintain a distance to each other. As a consequence, a parallel clearance distance between the cover plates 2 and 3 is produced resulting in a positioning arrangement symmetrical to the middle plane 12, (FIG. 5). The movable crimping die 26, can also be replaced when the retractable bolt 28 is loosened and removed and replaced respectively. The movable crimping die 26 is thereby seated with its circumferentially opened opening 23 directly on the stationary bolt 29 at the frontal end area 17 of the movable handle 14. The retractable bolt 28 and the stationary bolt 29 in the pliers head 1 are arranged to offer relative transposition to the cover plates 2 and 3 in the direction indicated by the arrow 31. For return travel of the movable crimping die 26 to its initial open position, which is still to be described, a connection link 35 is included that is passed through by the retractable bolt 28 and the stationary bolt 29. In FIGS. 3 and 4, the internal parts of the crimping pliers are also represented as a solid line in order to make the course of movement and the interaction of the parts better recognizable. An automatic locking mechanism 36 is located in the clearance area between the two cover plates 2 and 3. The automatic locking mechanism 36 includes a lock pawl 37 which is pivotable around an axle 38 and, a projecting tooth at the edge. A tension spring 39 secures the initial position or zero position of the lock pawl 37. The projecting tooth as the edge of the lock pawl 37 operates in conjunction with a tooth segment 40 which is disposed at the side of the frontal end area 17 of the stamped component 15 of the movable handle 14. The automatic locking mechanism 36 is activated, upon closing the crimping pliers and, upon opening the crimping pliers. The pin which forms the axle 38 is flush with its ends on the surface of the cover plates 2 and 3. There is a slot in at least one of its ends for the arbitrary purpose of inserting a screwdriver in order to be able to end an incorrectly started opening or closing operation, i.e. the possibility of eliminating the action of the automatic locking mechanism 36 in emergency cases or in cases of defects. The pivotability of the lock pawl 37 in both directions of rotation is, however, limited by stops 41 and 42. The stop 41 is formed by the edge of the movable crimping die 26. The stop 42 is formed by the section of the stamped component 5 of the stationary handle 4 extending into the pliers head 1.

It is preferred that a return spring 43 is included for opening the crimping pliers after completion of a compression operation. The return spring 43 is connected between the notch 44 and the toggle lover link 10. The return spring 43 is seated on the guide pin 45. The guide pin 45 is connected to a recess on the toggle lever link 10. This part is also arranged between the two cover plates 2 and 3, therefore, the return spring 43 is protected and remains covered so that damage to the return spring 43 is eliminated. By loosening the bolt 7, the stationary handle 4 can be pivoted around the shaft of the bolt 8 so that, for example, in the case of breakage to the spring, the return spring 43 can be removed and can be replaced with a new one.

FIG. 5 illustrates the retractable bolt 28 with the positioning end stop 46. The retractable bolt 28 and end stop 46 are one-piece construction which, on insertion, holds the workpiece in the desired relative position to the die plate of crimping dies 20, 26. Also, within the two plates 20*a* and 20*b* of the crimping die 20 a movable end stop 47 (FIG. 4 and 5) can be specified at the opposing end.

Figure 6:
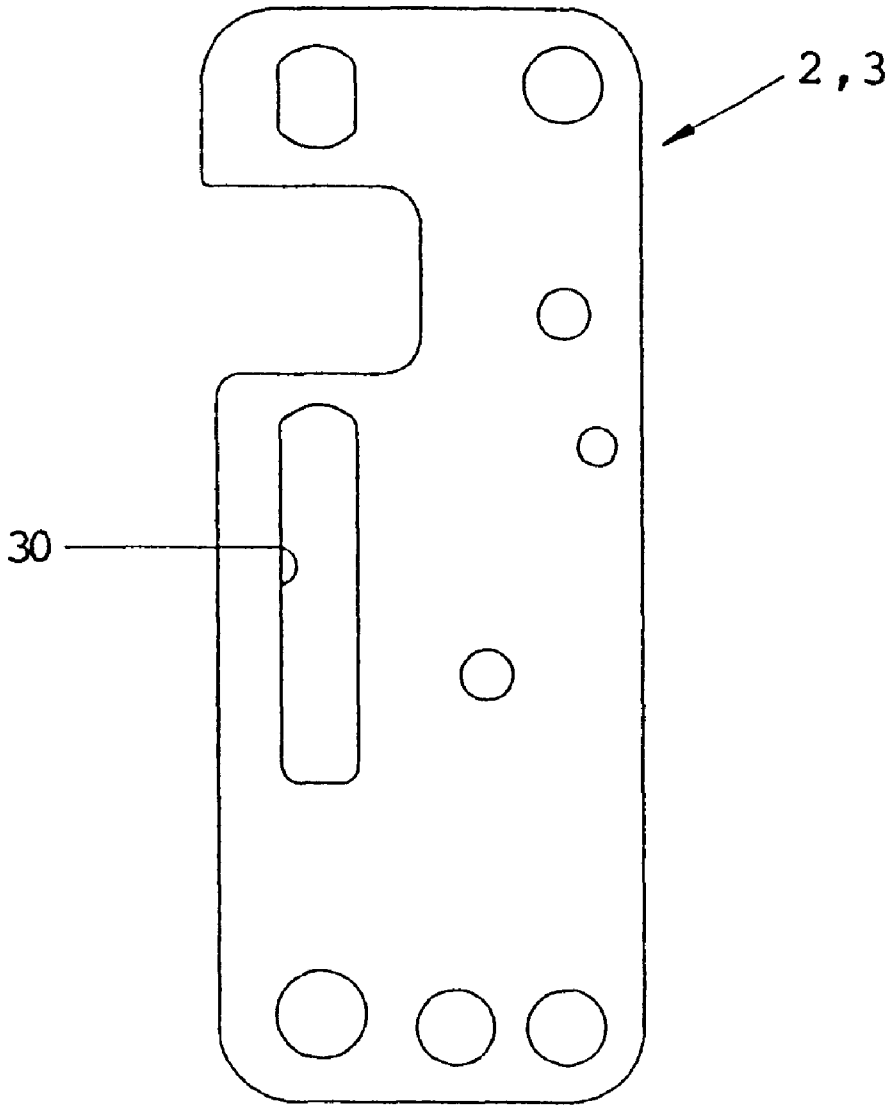
FIG. 6 illustrates a top view of a cover plate.
Figure 8:
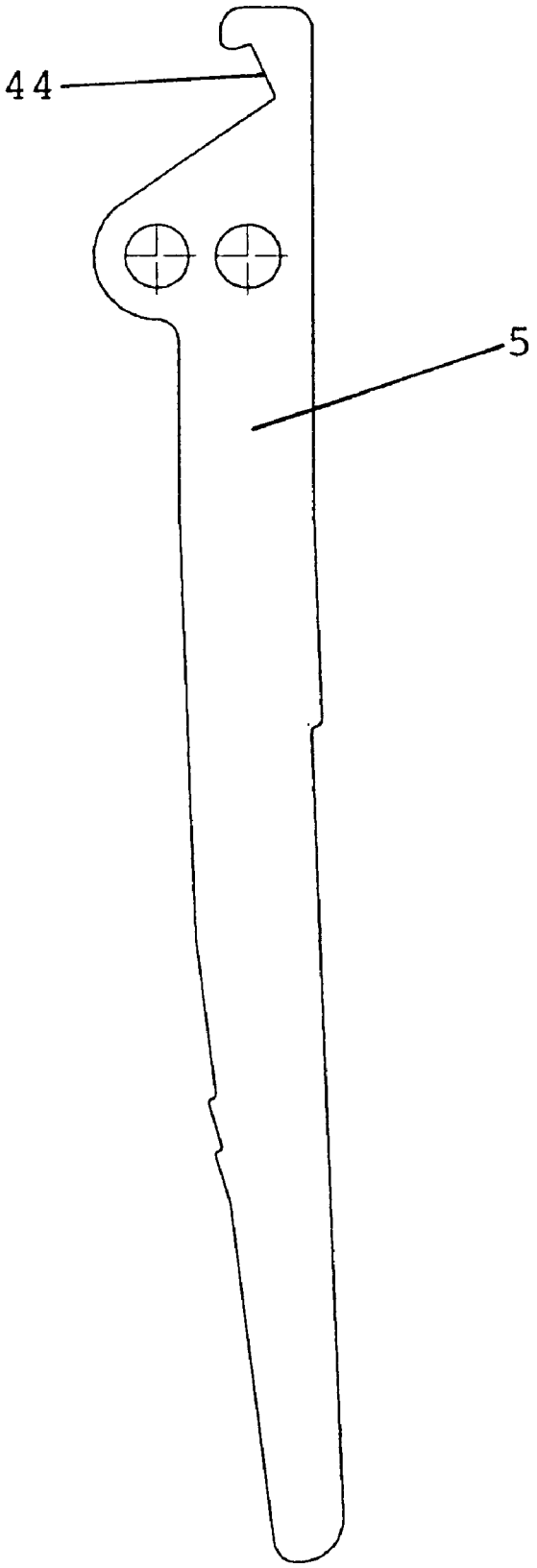

FIG. 6 and FIG. 8 illustrate the construction of the cover plates 2, 3 of the stamped component 15 of the movable handle 14 and the stamped component 5 of the stationary handle 4.

The replacement of the crimping dies 20 and 26 respectively is executed in the open position of the pliers in accordance with FIG. 3.

It is preferable to replace the stationary crimping die 20, by removing the retractable bolt 18. The crimping die 20 is pulled out in the horizontal direction between the two cover plates 2 and 3. A new or different stationary crimping die 20 is inserted in the opposite direction and the bolt 18 is reinserted.

Also in the case of replacing the movable crimping die 26, the retractable bolt 28 must only be removed. In this way, the connection tab 35 is freed simultaneously. The movable crimping die 26 is initially removed in the vertical direction from the clearance area between the cover plates 2 and 3 and exchanged for another crimping die 26. In an embodiment where the retractable bolt 28 is one-piece unit, it is necessary to observe the arrangement to the corresponding crimping die 26. Upon inserting of the bolt 28, the connection to the connection link 35 is also made. As a consequence, it is not necessary to manipulate the return spring 43 on replacement of the crimping dies 20 and/or 26. The automatic locking mechanism 36 also does not interfere with the replacement.

While a preferred embodiment of the invention has been disclosed in the foregoing specification, it is understood by those skilled in the art that variations and modifications thereof can be made without departing from the spirit and scope of the invention, as set forth in the following claims.

LIST OF REFERENCE NUMERALS

1—pliers head
2—cover plate
3—cover plate
4—handle
5—stamped component
6—plastic covering
7—bolt
8—bolt
9—pin
10—toggle lever link
11—axis
12—center plane
13—pin
14—handle
15—stamped component
16—plastic covering
17—end section
18—bolt
19—bolt
20—Crimping die
21—die plate
22—circumferentially closed opening
23—circumferentially opened opening
24—support
25—support
26—crimping die
27—die plate
28—bolt
29—bolt
30—elongated cut-out holes
31—double arrow
32—perforation
33—toggle lever drive
34—pin
35—connection link
36—automatic locking mechanism
37—lock pawl
39—tension spring
40—tooth segment
41—end stop
42—end stop
43—return spring
44—notch
45—guide pin

46—stop

47—end stop

We claim:

1. Pliers for crimping workpieces comprising:

a plier head having at least two parallel spaced cover plates attached to each other, said plier head having a free end area and an attached end area;

a linearly movable crimping die being slidably mounted to said pliers head;

a stationary crimping die being fixedly attached to said pliers head, at least one of said dies being a replaceable crimping die, said replaceable crimping die having a circumferentially closed opening and a circumferentially open opening;

a stationary handle being fixedly attached at one end to said pliers head;

a moveable handle having one end movably mounted to said pliers head and an operative end movable in an arc toward and away from said stationary handle;

a toggle lever drive having a toggle link pivotally arranged on said movable handle and on said stationary handle, wherein said toggle lever drive moves said linearly movable crimping die toward and away from said stationary die in response to the movement of said operative end of said movable handle moving toward and away from said stationary handle;

a retractable first support slidably mounting said replaceable crimping die to said pliers head, said retractable first support engagable with said circumferentially closed opening of said replaceable crimping die and being removable from said replaceable crimping die for removing said replaceable crimping die from said pliers head; and a second support slidably mounting said replaceable crimping die to said pliers head, said second support being engagable with said circumferentially open opening of said replaceable crimping die and with said pliers head, said circumferentially open opening being mountable about said second support to hold said replaceable crimping die on said pliers head;

whereby said second support remains connected to said pliers head upon removal and replacement of said replaceable crimping die.

2. The pliers of claim 1, further comprising:

a return spring, said return spring being disposed between said pair of cover plates said return spring having a fixed end and a movable end, said fixed end being fixed to said stationary handle and said movable end being fixed to said toggle link.

3. Pliers for crimping workpieces comprising:

a pliers head having at least two parallel spaced cover plates attached to each other, said pliers head having a free end area and an attached end area;

a linearly movable crimping die being sidably mounted to said pliers head;

a stationary crimping die being fixedly attached to said pliers head, at least one of said dies being a replaceable crimping die, said replaceable crimping die having a circumferentially closed opening and a circumferentially open opening;

a stationary handle being fixedly attached at one end to said pliers head;

a moveable handle having one end movably mounted to said pliers head and an operative end movable in an arc toward and away from said stationary handle;

a toggle lever drive having a toggle link pivotally arranged on said movable handle and on said stationary handle, wherein said toggle lever drive moves said linearly movable crimping die toward and away from said stationary die in response to the movement of said operative end of said movable handle moving toward and away from said stationary handle;

a retractable first support slidably mounting said replaceable crimping die to said pliers head, said retractable first support engagable with said circumferentially closed opening of said replaceable crimping die and being removable from said replaceable crimping die for removing said replaceable crimping die from said pliers head; and a second support slidably mounting said replaceable crimping die to said pliers head, said second support being engagable with said circumferentially open opening of said replaceable crimping die and with said pliers head, said circumferentially open opening being mountable about said second support to hold said replaceable crimping die on said pliers head;

whereby said second support remains connected to said pliers head upon removal and replacement of said replaceable crimping die;

an elongated slot, said elongated slot being disposed in one of said pair of cover plates, wherein said retractable first support and said second support are disposed through said elongated slot and guided therein.

4. Pliers for crimping workpieces comprising:

a pliers head having at least two parallel spaced cover plates attached to each other, said pliers head having a free end area and an attached end area;

a linearly movable crimping die being slidably mounted to said pliers head;

a stationary crimping die being fixedly attached to said pliers head, at least one of said dies being a replaceable crimping die, said replaceable crimping die having a circumferentially closed opening and a circumferentially open opening;

a stationary handle being fixedly attached at one end to said pliers head;

a moveable handle having one end movably mounted to said pliers head and an operative end movable in an arc toward and away from said stationary handle;

a toggle lever drive having a toggle link pivotally arranged on said movable handle and on said stationary handle, wherein said toggle lever drive moves said linearly movable crimping die toward and away from said stationary die in response to the movement of said operative end of said movable handle moving toward and away from said stationary handle;

a retractable first support slidably mounting said replaceable crimping die to said pliers head, said retractable first support engagable with said circumferentially closed opening of said replaceable crimping die and being removable from said replaceable crimping die for removing said replaceable crimping die from said pliers head; and a second support slidably mounting said replaceable crimping die to said pliers head, said second support being engagable with said circumferentially open opening of said replaceable crimping die and with said pliers head, said circumferentially open opening being mountable about said second support to hold said replaceable crimping die on said pliers head;

whereby said second support remains connected to said pliers head upon removal and replacement of said replaceable crimping die;

an elongated slot, said elongated slot being disposed in one of said pair of cover plates, wherein said retractable first support and said second support are disposed through said elongated slot and guided therein; and a connection link joining said retractable first support and said second support, said connection link being detachable by removal of said retractable first support, said connection link is linearly movable with said retractable first support and said second support, thereby guiding said movable crimping die upon movement of said movable handle wherein said movement is translated through said toggle link.

5. Pliers for crimping workpieces comprising:

a pliers head having at least two parallel spaced cover plates attached to each other, said pliers head having a free end area and an attached end area;

a linearly movable crimping die being slidably mounted to said pliers head;

a stationary crimping die being fixedly attached to said pliers head, at least one of said dies being a replaceable crimping die, said replaceable crimping die having a circumferentially closed opening and a circumferentially open opening;

a stationary handle being fixedly attached at one end to said pliers head;

a moveable handle having one end movably mounted to said pliers head and an operative end movable in an arc toward and away from said stationary handle;

a toggle lever drive having a toggle link pivotally arranged on said movable handle and on said stationary handle, wherein said toggle lever drive moves said linearly movable crimping die toward and away from said stationary die in response to the movement of said operative end of said movable handle moving toward and away from said stationary handle;

a retractable first support slidably mounting said replaceable crimping die to said pliers head, said retractable first support engagable with said circumferentially closed opening of said replaceable crimping die and being removable from said replaceable crimping die for removing said replaceable crimping die from said pliers head; and a second support slidably mounting said replaceable crimping die to said pliers head, said second support being engagable with said circumferentially open opening of said replaceable crimping die and with said pliers head, said circumferentially open opening being mountable about said second support to hold said replaceable crimping die on said pliers head;

whereby said second support remains connected to said pliers head upon removal and replacement of said replaceable crimping die;

an elongated slot, said elongated slot being disposed in one of said pair of cover plates, wherein said retractable first support and said second support are disposed through said elongated slot and guided therein;

a connection link joining said retractable first support and said second support, said connection link being detachable by removal of said retractable first support, said connection link is linearly movable with said retractable first support and said second support, thereby guiding said movable crimping die upon movement of said movable handle wherein said movement is translated through said toggle link; and a stop, defined by said retractable first support of said linearly movable crimping die for positioning a workpiece with respect to said dies.

6. The pliers of claim 1, wherein said replaceable crimping die comprises a laminated design.

7. The pliers of claim 2, wherein both of said linearly movable crimping die and said stationary crimping die are a replaceable crimping die.

8. The pliers of claim 1, further comprising:

an automatic locking mechanism having a tooth segment and a lock pawl, said lock pawl being pivotally disposed in said plier head, said tooth segment being disposed on movably mounted end of said movable handle, wherein said automatic locking mechanism provides for repeatable accuracy in end position of said movable handle when moved.

9. The pliers of claim 8, wherein said lock pawl is disposed between said pair of cover plates and limited in movement between a portion of said stationary crimping die and a portion of said stationary handle.

10. The pliers of claim 1, wherein said pliers head is a hollow housing formed by said pair of cover plates disposed parallel to each other and spaced a distance apart, wherein said stationary crimping die and said linearly movable crimping die are replaceable and disposable between said pair of cover plates.

11. The pliers of claim 1, further comprising:

a double support, said double support fixing said replaceable crimping die to said pliers head, said double support comprising said retractable first support and said second support.

* * * * *